US006217400B1

(12) United States Patent
Natsume

(10) Patent No.: US 6,217,400 B1
(45) Date of Patent: Apr. 17, 2001

(54) CONTROL FOR MARINE TRANSMISSION

(75) Inventor: Noriyuki Natsume, Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/315,438

(22) Filed: May 20, 1999

(30) Foreign Application Priority Data

May 22, 1998 (JP) ..... 10-141097

(51) Int. Cl.[7] ..... B63H 20/14
(52) U.S. Cl. ..... 440/75
(58) Field of Search ..... 440/75

(56) References Cited

U.S. PATENT DOCUMENTS 4,302,196 * 11/1981 Blanchard ..... 440/75
4,530,667 * 7/1985 McCormick ..... 440/75
4,689,027 * 8/1987 Harada et al. ..... 440/75
4,861,295 * 8/1989 McElroy, Jr. et al. ..... 440/86
5,151,059 * 9/1992 Higby ..... 440/75
5,575,698 * 11/1996 Ogino ..... 440/75

FOREIGN PATENT DOCUMENTS 1-119499 * 5/1989 (JP) ..... 440/75

* cited by examiner

*Primary Examiner*—S. Joseph Morano
*Assistant Examiner*—Andrew Wright
(74) *Attorney, Agent, or Firm*—Ernest A. Beutler

(57) ABSTRACT

An improved control mechanism for a marine transmission that provides an effective shift control by forming a crank arm at the lower end of the shift rod which lies below a cylindrical bearing portion. These parts are passed through a key hole shaped opening in the lower unit so that when fully assembled, the bearing portion of the shift rod will be journaled in the cylindrical portion of the key hole shaped slot so as to provide a good bearing arrangement.

6 Claims, 4 Drawing Sheets

CONTROL FOR MARINE TRANSMISSION

BACKGROUND OF THE INVENTION

This invention relates to a control for a marine transmission and more particularly to an improved actuator assembly for such transmissions.

Conventional marine transmissions employ a driveshaft which has a bevel gear that is affixed to its lower end and which is engaged with a pair of diametrically opposed, and hence, counter-rotating-driven beveled gears. This driven bevel gears are journaled on the propeller shaft and are selectively clutched for driving relationship therewith by a dog-clutching mechanism that is positioned between the bevel gears.

It is conventional to utilize a shift plunger which extends into one end of the propeller shaft and which operates in conjunction with a pin that carries the dogclutching element for effecting the axial shifting of the dog-clutching element into engagement with selected ones of the driven counter-rotating bevel gears.

Various types of mechanisms have been employed for actuating the shift plunger. Some of these utilize a cam mechanism that is operated by a rotating cam formed at the lower end of a shift rod which is actuated by the vessel operator. This cam mechanism requires the cam to be held against rotation about the propeller shaft axis while the shift plunger does rotate along with the pin that couples it to the dog-clutching element. Hence, a number of small pieces must be assembled together in order to complete this mechanism. This adds to the cost and complexity and also gives an area where failures may occur.

Another type of mechanism employs a crank pin that operates in a slot in the shift plunger. This eliminates the need for the connecting member to permit relative rotation. However, these types of mechanisms require a fairly large bearing area and generally make it difficult to keep a small size for the lower unit. If the lower unit's size is increased, particularly at its forward end where this mechanism resides, then hydrodynamic drag can be unacceptably increased.

It is, therefore, a principal object of this invention to provide an improved transmission control for a marine transmission reversing-gear shifting mechanism.

It is a further object of this invention to provide an improved actuating mechanism for the shift plunger of a marine transmission that can be relatively small in operation and size, can be conveniently assembled, and also will have a relatively large bearing area.

SUMMARY OF THE INVENTION

This invention is adapted to be embodied in a marine transmission that is comprised of a propeller shaft having a pair of counter-rotating-driven bevel gears journaled on its forward end. A dog-clutching element is disposed in keyed relationship with the propeller shaft between these driven bevel gears. The dog clutching element is axially movable therealong to effect driving engagement between selected ones of the driven bevel gears and the propeller shaft. A shift plunger extends within a bore formed in this end of the propeller shaft and is coupled to the dog-clutching element for effecting its reciprocation into driving engagement with the selected driven bevel gear.

An area at the upper portion of the lower unit is formed with a key hole shaped opening through which a shift rod passes. The shift rod has a cylindrical bearing portion that is complementary in diameter to the cylindrical portion of the key hole shaped opening, and thus is rotatably journaled therein. A crank arm depends from this bearing portion and is engaged in a groove formed in the shift plunger for operating the shift plunger upon rotation of the shift rod. The crank arm has an offset dimension which is only slightly less than the long dimension of the key hole shaped slot, so that it can pass through the key hole shaped slot for assembly purposes.

DETAILED DESCRIPTION OF THE PREFERRED EMBODIMENT OF THE INVENTION

Figure 1:
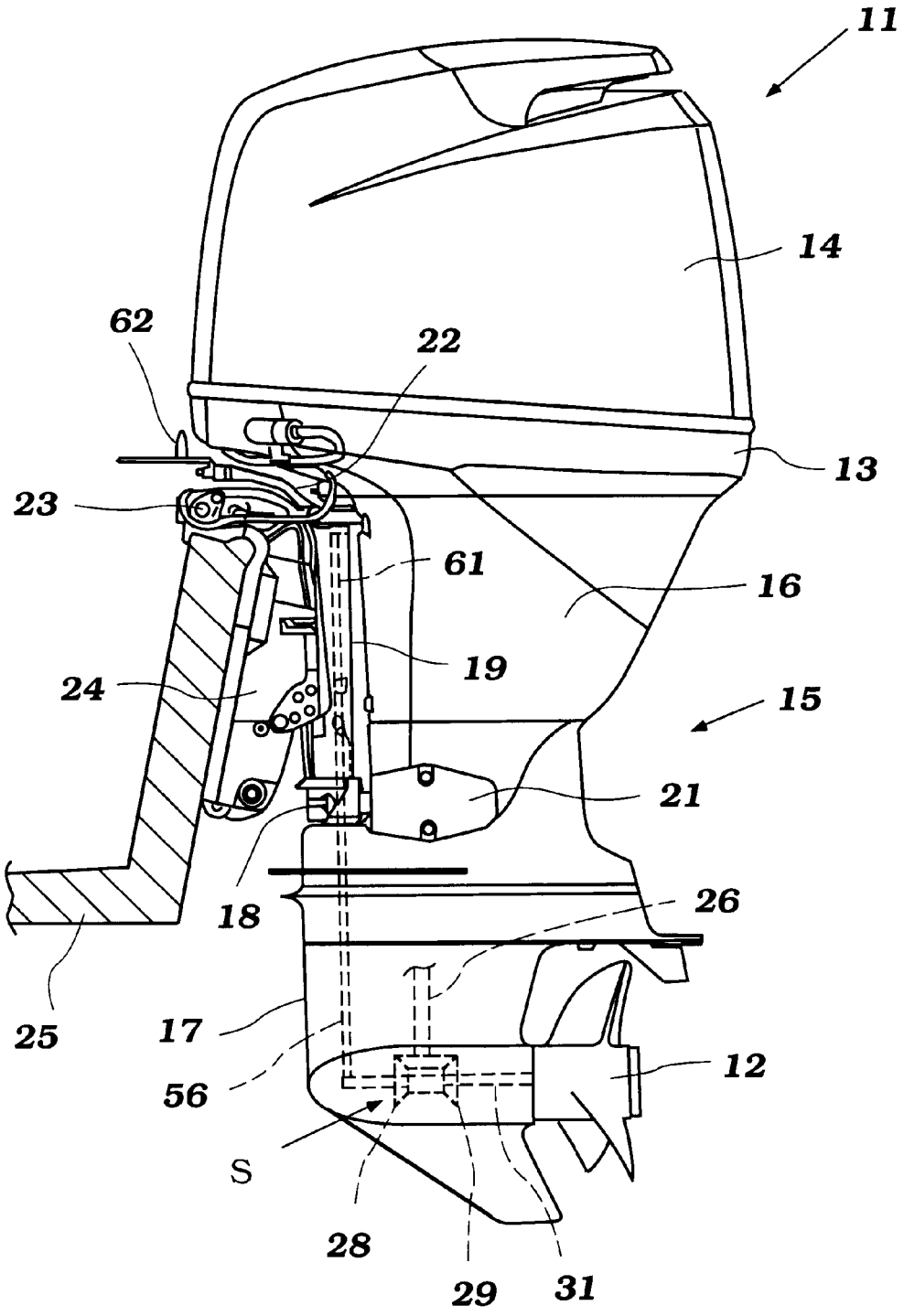
FIG. 1 is a side elevational view of an outboard motor constructed in accordance with an embodiment of the invention.

Referring now in detail to the drawings and initially to FIG. 1, an outboard motor constructed in accordance with an embodiment of the invention is identified generally by the reference numeral 11. Although the invention is described in conjunction with an outboard motor, the invention deals primarily with the transmission for transmitting driving forces to a propeller 12. Therefore, the invention may also be practiced in conjunction with other types of marine outboard drives, such as an inboard/outboard drive that utilizes a similar type of transmission to an outboard motor.

The outboard motor 11 is comprised of a power head that consists of a powering internal combustion engine which is not shown and may be of any well-known type. This engine is surrounded by a protective cowling comprised of a lower tray portion 13 and an upper main cowling portion 14 that is detachably connected to the tray portion 13 in any suitable manner.

A lower unit, indicated generally by the reference numeral 15, depends from the power head and is comprised of an upper driveshaft housing casing 16 and a lower unit casing 17, which are connected to each other in a suitable manner.

A steering shaft 18 is journaled for steering rotation within a swivel bracket 19. The steering shaft 18 is connected by means of a lower connecting member 21 and an upper connecting member, which is not shown, to the driveshaft housing 16, for steering of the outboard motor 11 about a vertically extending steering axis. A tiller 22 is affixed to the upper end of the steering shaft 18 for effecting this steering movement.

The swivel bracket 19 is pivotally connected by means of a pivot pin 23 to a clamping bracket 24. The pivot pin 23 permits tilt-and-trim adjustment of the outboard motor 11, in a manner well-known in the art.

The clamping bracket 24 has a mechanism by which it may be clamped to the transom of a watercraft hull, which is shown partially and in cross-section in FIG. 1, and identified by the reference numeral 25.

Referring now primarily to the remaining figures, the engine which is mounted in the power head has its output shaft coupled to a vertically extending driveshaft 26 that is journaled in a suitable manner within the driveshaft housing and lower unit 15. This driveshaft 26 depends into the lower unit outer housing 17.

A bevel driving gear 27 is affixed for rotation with the lower end of the driveshaft 26. This driving bevel gear 27 forms a portion of a reversing transmission and shift mechanism, indicated generally by the reference character S, that is contained within the lower unit housing 17.

A pair of driven bevel gears 28 and 29 are journaled on the forward end of a propeller shaft 31 to which the propeller 12 is affixed in a known manner. Because these driven bevel gears 28 and 29 are engaged with diametrically opposite sides of the driving bevel gear 27, these gears will be driven in opposite directions of rotation as the driveshaft 26 rotates. The driven bevel gears 28 and 29 have hub portions that are journalled by bearings 30 in the lower unit 17.

The driven bevel gears 28 and 29 have facing dog-clutching teeth 32 and 33 formed on opposite sides of a dog clutching element 34. The dog-clutching element 34 has a splined connection to the propeller shaft 31 and oppositely facing dog-clutching teeth 35 and 36. These teeth 35 and 36 are adapted to be brought into engagement with selective of the teeth 32 and 33 associated with the driven gears 28 and 29, for establishing a driving relationship between those gears and the propeller shaft 31. When so engaged, the propeller shaft 31 and propeller 12 will be driven in selected forward or reverse directions.

The construction, as thus far described, may be considered to be conventional. The invention deals with the mechanism for shifting the dog-clutching element 34 between the neutral position shown in FIG. 2, and the forward or reverse drive positions.

This mechanism includes a shift plunger 37 that is slidably supported within a bore 38 formed in the forward end of the propeller shaft 31. A drive pin 39 extends through an opening 41 formed in the rear end of this shift plunger 37. This drive pin 39 also extends through a slotted opening formed in the propeller shaft 31 and into receptive openings formed in the dog-clutching element 34. A spring encircles the ends of the pin 39 and holds it in place.

Figure 2:
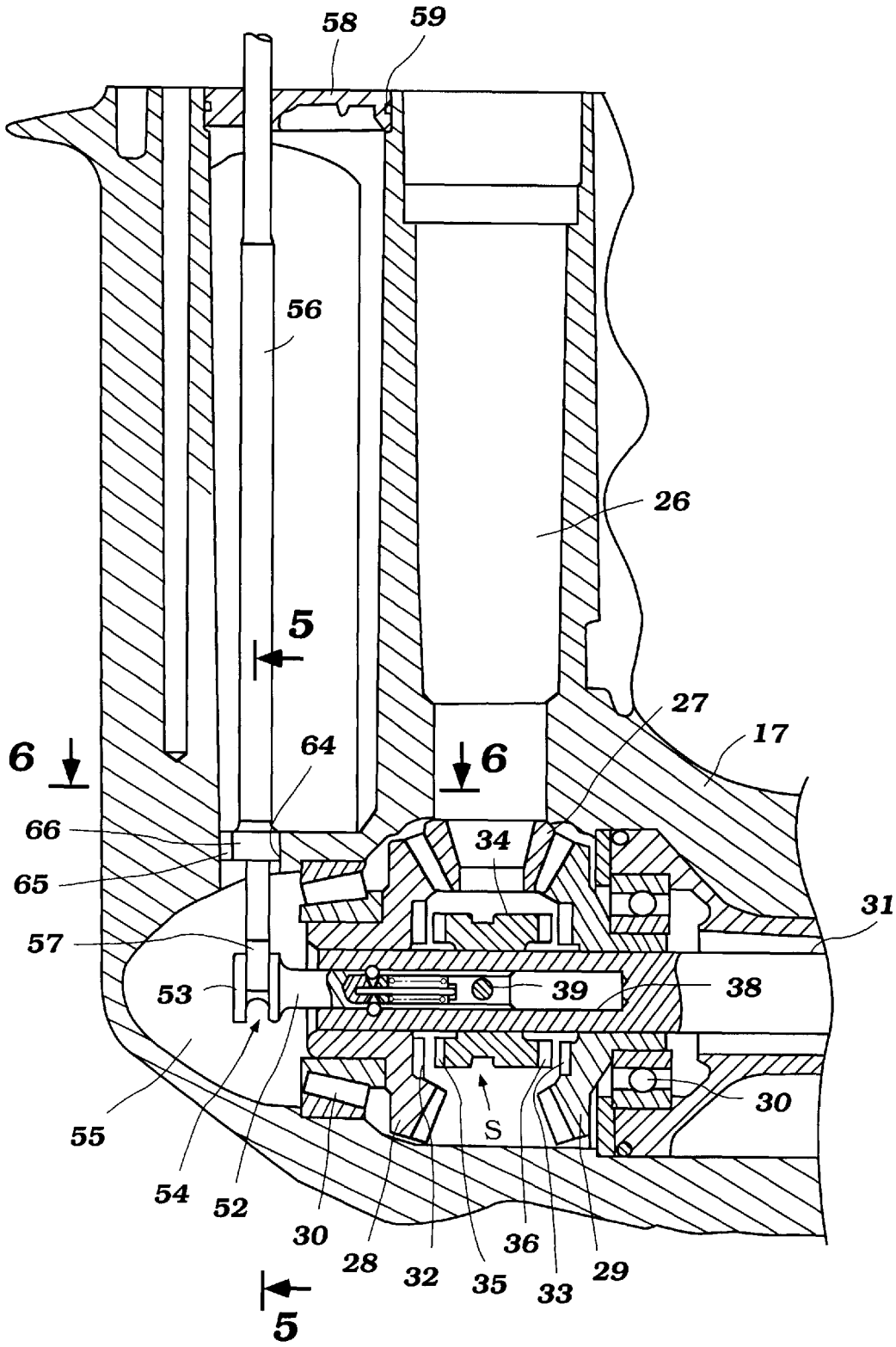
FIG. 2 is an enlarged cross-sectional view taken through the forward end of the lower unit of the outboard motor and shows the transmission and transmission actuating mechanism in cross-section.

The shift plunger 37 also includes a detent locking mechanism for releasably retaining the shift plunger 37 in the neutral position, as shown in FIG. 2, and may also cooperate so as to releasably retain the dog-clutching element 34 and shift plunger 37 in either or both of the forward or reverse drive positions.

This detent mechanism comprises a plurality of detent balls 42 that are trapped between a pair of collar members 43 and 44. The collar member 43 is slidable upon a rod 45 which is fixed at one end to a caging member 46. A coil compression spring 47 acts between the collar member 43 and the end plate 46.

The rod 45 has a threaded connection to another end plate 48 which is engaged with the collar 44. Hence, the spring 45 tends to urge the detent balls 42 outwardly through openings 49 formed in the plunger 37 so as to engage detent recesses 51 formed in the interior surface of the propeller shaft 31 so as to achieve the releasable locking afore referred to. If sufficient force is exerted, the balls 42 will be cammed inwardly to permit the shift to be effected.

The forward end of the plunger 37, indicated by the reference numeral 52, is formed with a headed portion 53 that defines a slot 54. This extends into a cavity 55 formed at the front of the lower unit housing 17.

A shift rod 56, which is inserted and journaled in a manner to be described, has an offset crank arm end portion 57 that is received in the slot 54. As a result, the plunger 37 may rotate, but the crank arm 57 can effect reciprocation of the plunger 37 along the axis of the propeller shaft 31 within the bore 38.

Figure 3:
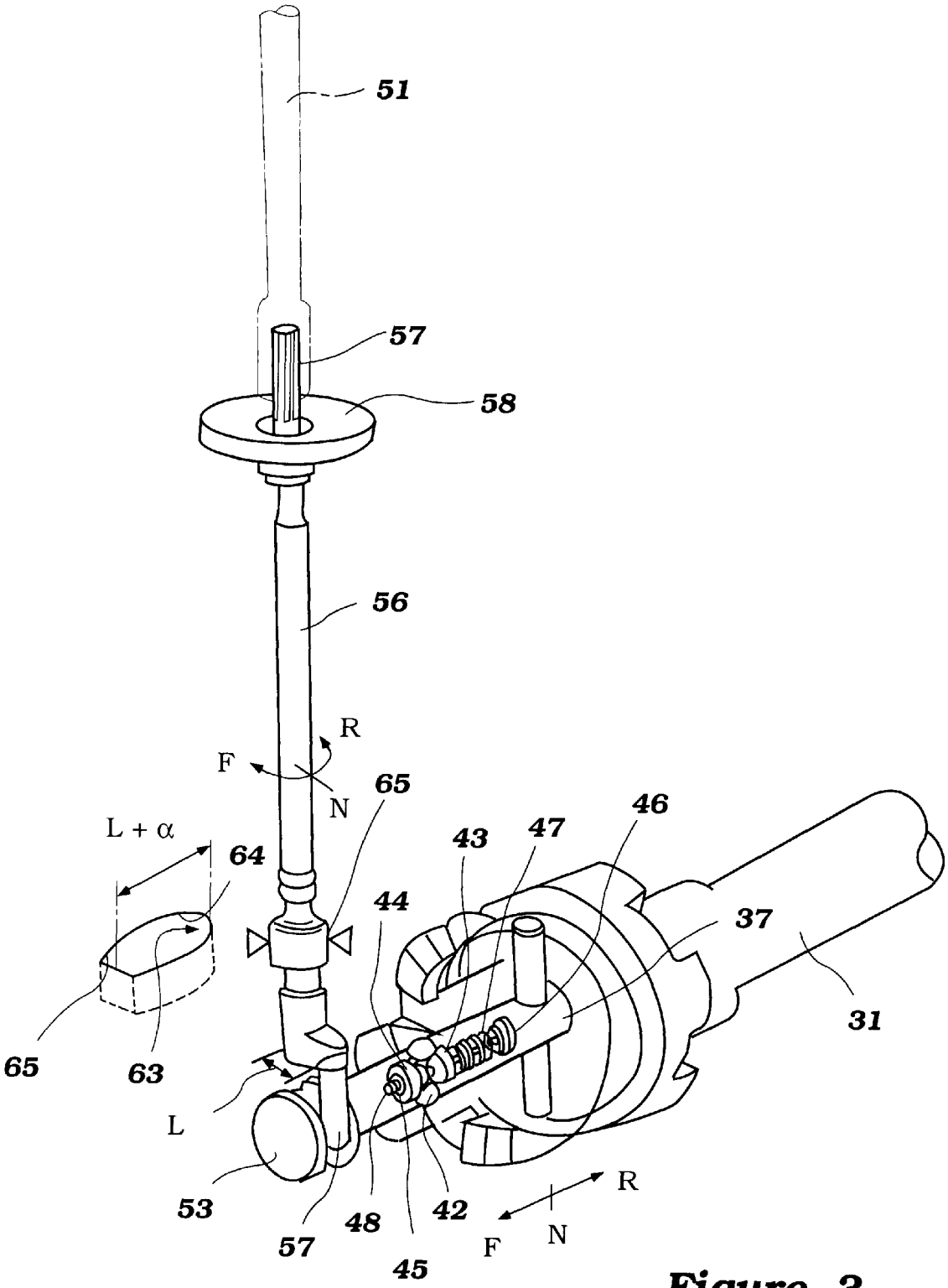
FIG. 3 is a partially exploded, perspective view showing the mechanism illustrated in FIG. 2 with the slotted opening that receives the shift rod moved forwardly so as to more clearly show its shape.
Figure 4:
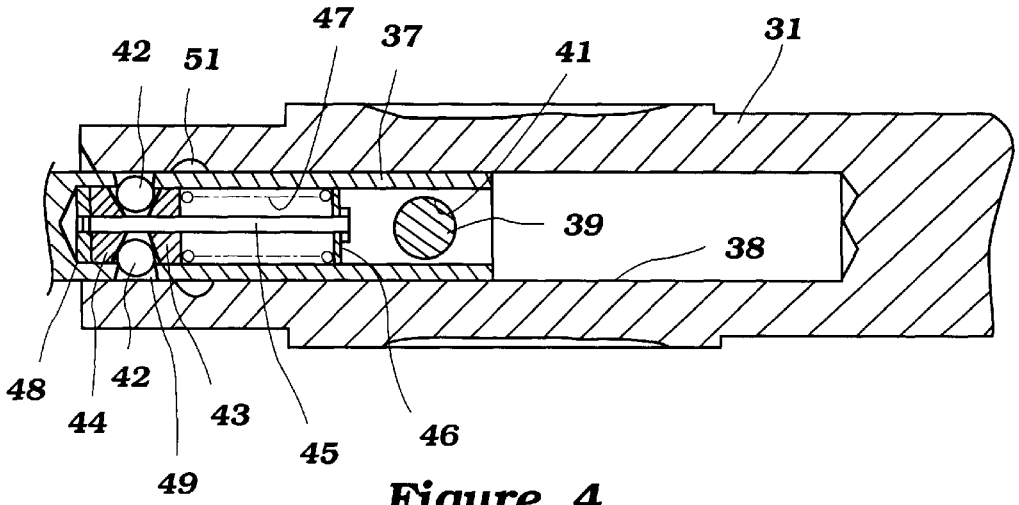
FIG. 4 is an enlarged cross-sectional view taken through the forward end of the propeller shaft and is generally an enlargement of the portion show in cross-section in FIG. 2.
Figure 5:
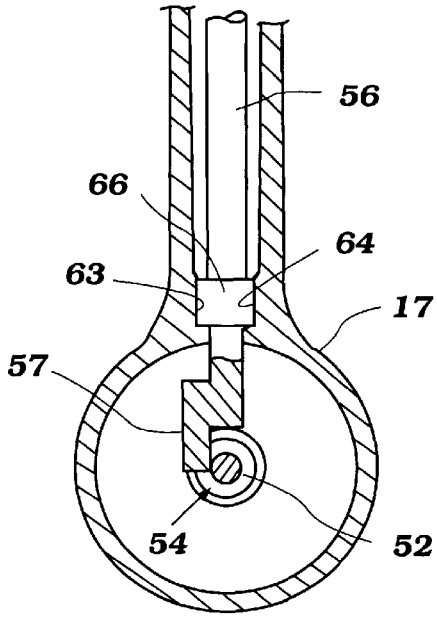
FIG. 5 is a cross-sectional view taken along the line 5—5 of FIG. 2.
Figure 6:
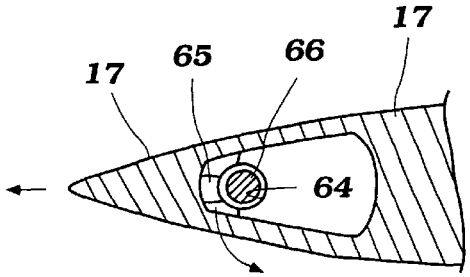
FIG. 6 is cross-sectional view taken along the line 6—6 of FIG. 2.

As best seen in FIG. 3, the upper end of the shift rod 56 is formed with a splined portion 60 which passes through a guide plate 58 that is received in an opening 59 formed in the upper end of the forward part of the lower unit housing 17.

A shift actuating rod 61 has a female splined portion that is received over the male splines 60 so as to effect rotation of the shift rod 56. The shift actuating rod 61 extends upwardly through an opening in the steering shaft 18 and is rotated by a shift actuator 62 carried at the forward end of the tiller 22.

The lower portion of the opening through which the shift rod 56 extends is formed with a key hole shaped opening 63 which has at its rear end a generally cylindrical portion 64 that has a diameter which is complementary to the diameter of a bearing portion 66 formed on the lower end of the shift rod 63. From this cylindrical part, the keyhole-shaped slot 56 has a pair of forwardly extending sides 65 which terminate at a flat edge that is spaced at a distance $L+\alpha$, that is slightly greater than the dimension L of the crank arm 57.

As a result, by rotating the shift rod 56 ninety degrees (90°) from the position shown in FIG. 3, it may be withdrawn from or inserted into the keyhole-shaped opening 63 and then rotated back into the position shown in FIG. 3 where it can register with the slot 54 upon further insertion. Once further inserted, the bearing portion 66 will be trapped in the cylindrical portion 64 of the slot 63 and the shift rod 56 will be held in position but free to rotate about the axis defined by the cylindrical portion 64 and the bearing portion 66. Hence, it is possible to provide a very easily assembled arrangement that minimizes the number of parts and which also can be easily assembled and which also permits the lower unit outer housing 17 and particularly the submerged portion thereof, to be kept quite small. As a result, the mechanism is made not only simpler and less expensive that the prior art type constructions, but is more reliable.

Of course, the foregoing description is that of a preferred embodiment of the invention, and various changes and modifications may be made without departing from the spirit and scope of the invention, as defined by the appended claims.

What is claimed is:

1. A marine transmission comprised of a lower unit journalling a propeller shaft having a pair of counter-rotating-driven bevel gears journaled on its forward end around an end portion of said propeller shaft, a dog clutching element disposed in keyed relationship with said propeller shaft between said driven bevel gears, said dog clutching element being axially movable along said propeller shaft to effect driving engagement between selected ones of said driven bevel gears and said propeller shaft, a shift plunger extending within a bore formed in said propeller shaft end coupled to said dog clutching element for effecting its reciprocation into driving engagement with the selected one of said driven bevel gears, an area at an upper portion of said lower unit is formed with an elongated opening through which a shift rod passes, said shift rod having a cylindrical bearing portion that is complementary in diameter to a cylindrical portion of said elongated opening, and thus is rotatably journaled therein, and a crank arm depending from said bearing portion and is engaged in a groove formed in said shift plunger for operating said shift plunger upon rotation of said shift rod, said crank arm has an offset dimension larger than the diameter of said cylindrical portion and slightly less than the long dimension of said elongated opening so that it can pass through said elongated opening for assembly purposes.

2. A marine transmission as set forth in claim 1 wherein the groove in the shift plunger is circumferential about the axis of the propeller shaft.

3. A marine transmission as set forth in claim 2 wherein the elongated of the lower unit elongated portion opening extends in a direction parallel to the propeller shaft axis.

4. A marine transmission as set forth in claim 1 wherein the elongated opening has a generally key hole shape.

5. A marine transmission comprised of a lower unit journalling, a propeller shaft hiving a pair of counter-rotating-driven bevel gears journaled on its forward end around an end portion of said propeller shaft, a dog clutching element disposed in keyed relationship with said propeller shaft between said driven bevel gears, said dog clutching element being axially movable along said propeller shaft to effect driving engagement between selected ones of said driven bevel gears and said propeller shaft, a shift plunger extending within a bore formed in said propeller shaft end coupled to said dog clutching element for effecting its reciprocation into driving engagement with the selected one of said driven bevel gears, an area at an upper portion of said lower unit is formed with an elongated opening having a generally key hole shape through which a shift rod passes, said shift rod having a cylindrical hearing portion that is complementary in diameter to a cylindrical portion of said elongated opening, and thus is rotatably journaled therein, and a crank arm depending from said hearing portion and is engaged in a groove formed in said shift plunger for operating said shift plunger upon rotation of said shift rod, said crank arm has an offset dimension slightly less than the long dimension of said elongated opening so that it can pass through said elongated opening for assembly purposes.

6. A marine transmission comprised of a lower unit journalling a propeller shaft having a pair of counter-rotating-driven bevel gears journaled on its forward end around an end portion of said propeller shaft, a dog clutching element disposed in keyed relationship with said propeller shaft between said driven bevel gears, said dog clutching element being axially movable along said propeller shaft to effect driving engagement between selected ones of said driven bevel gears and said propeller shaft, a shift plunger extending within a bore formed in said propeller shaft end coupled to said dog clutching element for effecting its reciprocation into driving engagement with the selected one of said driven bevel gears, an area at an upper portion of said lower unit is formed with an elongated opening the elongation of which extends in a direction parallel to said propeller shaft axis and through which a shift rod passes, said shift rod having a cylindrical bearing portion that is complementary in diameter to a cylindrical portion of said elongated opening, and thus is rotatably journaled therein, and a crank arm depending from said bearing portion and is engaged in a groove circumferential about the axis of said propeller shaft formed in said shift plunger for operating said shift plunger upon rotation of said shift rod, said crank arm has an offset dimension slightly less than the long dimension of said elongated opening so that it can pass through said elongated opening for assembly purposes.

* * * * *